US007503236B2

(12) United States Patent
Schlabach

(10) Patent No.: US 7,503,236 B2
(45) Date of Patent: Mar. 17, 2009

(54) PEDAL ASSEMBLY HAVING A HYSTERESIS MECHANISM

(75) Inventor: Roderic A. Schlabach, Fort Wayne, IN (US)

(73) Assignee: Wabash Technologies, Inc., Huntington, IN (US)

( * ) Notice: Subject to any disclaimer, the term of this patent is extended or adjusted under 35 U.S.C. 154(b) by 0 days.

(21) Appl. No.: 11/789,274

(22) Filed: Apr. 24, 2007

(65) Prior Publication Data

US 2007/0193396 A1 Aug. 23, 2007

Related U.S. Application Data

(63) Continuation of application No. PCT/US2006/023269, filed on Jun. 15, 2006.

(60) Provisional application No. 60/691,080, filed on Jun. 16, 2005.

(51) Int. Cl.
*G05G 1/14* (2006.01)

(52) U.S. Cl. ..... 74/513; 74/512; 74/560

(58) Field of Classification Search ..... 74/512–514, 74/560; 324/207.17, 207.25; *G05G 1/14*
See application file for complete search history.

(56) References Cited

U.S. PATENT DOCUMENTS

| | | | | |
|---|---|---|---|---|
| 5,529,296 | A | 6/1996 | Kato et al. | |
| 5,937,707 | A | 8/1999 | Rixon et al. | |
| 6,098,971 | A | 8/2000 | Stege et al. | |
| 6,158,299 | A | 12/2000 | Czajkowski | |
| 6,360,631 | B1 | 3/2002 | Wortmann et al. | |
| 6,426,619 | B1 | 7/2002 | Pfaffenberger et al. | |
| 6,474,191 | B1 | 11/2002 | Campbell | |
| 6,658,953 | B2 | 12/2003 | Lee | |
| 6,809,512 | B2 | 10/2004 | Pfaffenberger et al. | |
| 7,216,563 | B2 * | 5/2007 | Willemsen et al. | 74/512 |
| 7,278,337 | B2 * | 10/2007 | Solta | 74/513 |
| 7,296,494 | B2 | 11/2007 | Caba et al. | |
| 2002/0152831 | A1 * | 10/2002 | Sakamoto et al. | 74/512 |

(Continued)

FOREIGN PATENT DOCUMENTS

| | | |
|---|---|---|
| WO | WO 2004/007929 | 1/2004 |

(Continued)

*Primary Examiner*—Vinh T Luong
(74) *Attorney, Agent, or Firm*—Krieg DeVault LLP

(57) ABSTRACT

A pedal assembly for use in association with a vehicle includes a pedal support adapted for mounting to the vehicle. The pedal support includes a pivot shaft extending along a pivot axis and having an outer bearing surface. A pedal arm is rotatably engaged to the pivot shaft to allow pivotal movement of the pedal arm about the pivot axis. A clamp arm is pivotally coupled to the pedal arm and has a compression surface. A biasing member is engaged between the pedal support and the clamp arm and is arranged to apply a biasing force to the clamp arm to pivot the clamp arm relative to the pedal arm and toward the pivot shaft. Application of an activation force onto the pedal arm pivots the pedal arm about the pivot axis, which in turn increases the biasing force applied to the clamp arm by the biasing member to correspondingly increase frictional engagement between the compression surface of the clamp arm and the bearing surface of the pivot shaft to provide increased resistance to further pivotal movement of the pedal arm.

23 Claims, 5 Drawing Sheets

U.S. PATENT DOCUMENTS

2002/0175676 A1* 11/2002 Pfaffenberger et al. ... 324/207.2
2003/0066375 A1 4/2003 Menzies
2003/0154817 A1 8/2003 Staker
2004/0149070 A1 8/2004 Solta
2005/0097983 A1 5/2005 Mannie et al.
2006/0117902 A1* 6/2006 Martin et al. ..... 74/512
2007/0103149 A1 5/2007 Horie et al.
2007/0137400 A1* 6/2007 Campbell ..... 74/513
2008/0149411 A1* 6/2008 Schlabach et al. ..... 180/315

FOREIGN PATENT DOCUMENTS

WO WO 2004/007929 A2 * 1/2004 ..... 74/512

* cited by examiner

PEDAL ASSEMBLY HAVING A HYSTERESIS MECHANISM

CROSS REFERENCE TO RELATED APPLICATIONS

The present application is a continuation of International PCT Application No. PCT/US2006/023269, filed on Jun. 15, 2006 and published on Dec. 28, 2006 as International Publication No. WO 2006/138437, which claims the benefit of U.S. Provisional Patent Application Ser. No. 60/691,080 filed on Jun. 16, 2005, the entire contents of each application hereby being incorporated by reference.

FIELD OF THE INVENTION

The present invention relates generally to the field of pedal assemblies, and more particularly relates to a pedal assembly having a hysteresis mechanism.

SUMMARY OF THE INVENTION

While the actual nature of the invention covered herein can only be determined with reference to the claims appended hereto, certain forms of the invention that are characteristic of the preferred embodiments disclosed herein are described briefly as follows.

In one form of the present invention, a pedal assembly is provided for use in association with a vehicle, including a pedal support adapted for mounting to the vehicle and including a pivot shaft extending along a pivot axis and having an outer bearing surface, a pedal arm including a lever portion and a mounting portion rotatably engaged to the pivot shaft to allow pivotal movement of the pedal arm about the pivot axis, a clamp arm pivotally coupled to the pedal arm and having a compression surface facing the bearing surface of the pivot shaft, and a biasing member engaged between the pedal support and the clamp arm and arranged to apply a biasing force to the clamp arm to pivot the clamp arm relative to the pedal arm and toward the pivot shaft to provide frictional engagement between the compression surface and the bearing surface, and wherein application of an activation force onto the lever portion of the pedal arm provides the pivotal movement of the pedal arm about the pivot axis, with the pivotal movement of the pedal arm increasing the biasing force applied to the clamp arm by the biasing member to correspondingly increase frictional engagement between the compression surface of the clamp arm and the bearing surface of the pivot shaft to provide increased resistance to further pivotal movement of the pedal arm about the pivot axis.

In another form of the present invention, a pedal assembly is provided for use in association with a vehicle, including a pedal support adapted for mounting to the vehicle, a pedal arm including a lever portion and a mounting portion pivotally coupled to the pedal support to allow pivotal movement of the pedal arm about a pivot axis, a frictional member defining a bearing surface, a clamp arm pivotally coupled to the pedal arm and having a compression surface, a biasing member engaged between the pedal support and the clamp arm and arranged to apply a biasing force to the clamp arm to pivot the clamp arm relative to the pedal arm and toward the frictional member to provide frictional engagement between the compression surface and the bearing surface, a magnetic field generator providing a magnetic field and coupled to the pedal arm and arranged generally along the pivot axis such that pivotal movement of the pedal arm results in rotational displacement of the magnetic field about the pivot axis, and a magnetic sensor device comprising at least one magnetic flux sensor positioned within the magnetic field to sense variations in the magnetic field during the rotational displacement and to generate an output signal representative of a rotational position of the magnetic field relative to the at least one magnetic flux sensor, and wherein application of an activation force onto the lever portion of the pedal arm provides pivotal movement of the pedal arm about the pivot axis which increases the biasing force applied to the clamp arm by the biasing member to correspondingly increase frictional engagement between the compression surface of the clamp arm and the bearing surface of the frictional member to provide increased resistance to further pivotal movement of the pedal arm about the pivot axis.

In a further form of the present invention, a pedal assembly is provided for use in association with a vehicle, including a pedal support adapted for mounting to the vehicle and including a pivot shaft extending along a pivot axis and having an outer bearing surface, a pedal arm including a lever portion and a mounting portion having a pair of oppositely disposed flanges defining a space therebetween with at least one of the flanges defining a pivot shaft opening arranged along the pivot axis and sized to rotatably receive the pivot shaft therein to allow pivotal movement of the pedal arm about the pivot axis, a clamp arm positioned within the space between the pair of oppositely disposed flanges and pivotally coupled to the pedal arm and having a compression surface facing the bearing surface of the pivot shaft, a position sensing device located adjacent one of the oppositely disposed flanges and being operable to sense a pivotal position of the pedal arm relative to the pedal support and to generate an output signal representative of the pivotal position, and a biasing member engaged between the pedal support and the clamp arm and arranged to apply a biasing force to the clamp arm to pivot the clamp arm relative to the pedal arm and toward the pivot shaft to provide frictional engagement between the compression surface and the bearing surface, and wherein application of an activation force onto the lever portion of the pedal arm provides pivotal movement of the pedal arm about the pivot axis which increases the biasing force applied to the clamp arm by the biasing member to correspondingly increase frictional engagement between the compression surface of the clamp arm and the bearing surface of the pivot shaft to provide increased resistance to further pivotal movement of the pedal arm about the pivot axis.

DESCRIPTION OF THE PREFERRED EMBODIMENTS

Figure 1:
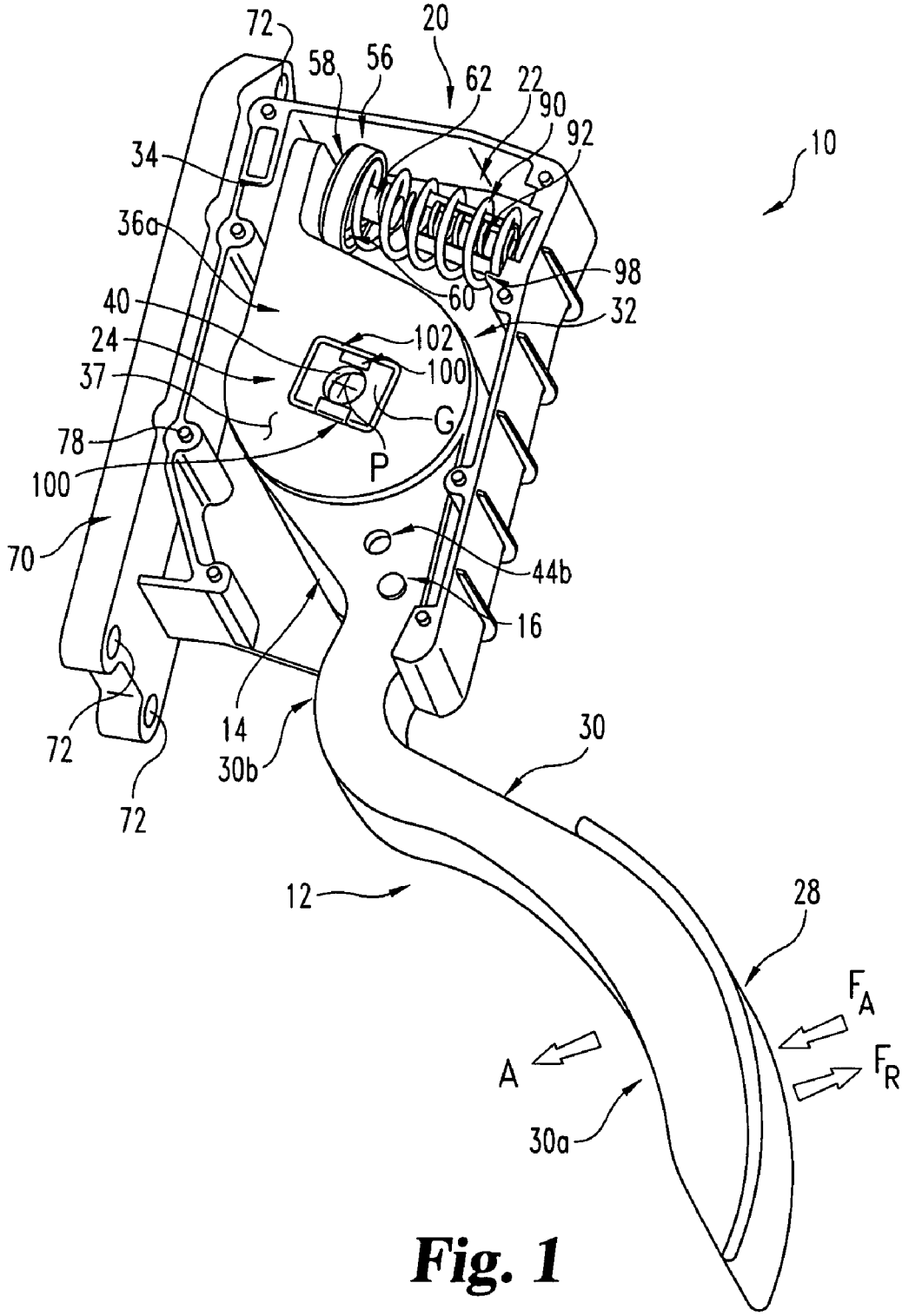
FIG. 1 is a perspective view of a pedal assembly according to one form of the present invention, as shown with the cover and magnetic sensor device removed for clarity.

For the purposes of promoting an understanding of the principles of the invention, reference will now be made to the embodiments illustrated in the drawings and specific language will be used to describe the same. It will nevertheless be understood that no limitation of the scope of the invention is hereby intended, and that alterations and further modifications to the illustrated devices and/or further applications of the principles of the invention as illustrated herein are contemplated as would normally occur to one skilled in the art to which the invention relates.

Figure 2:
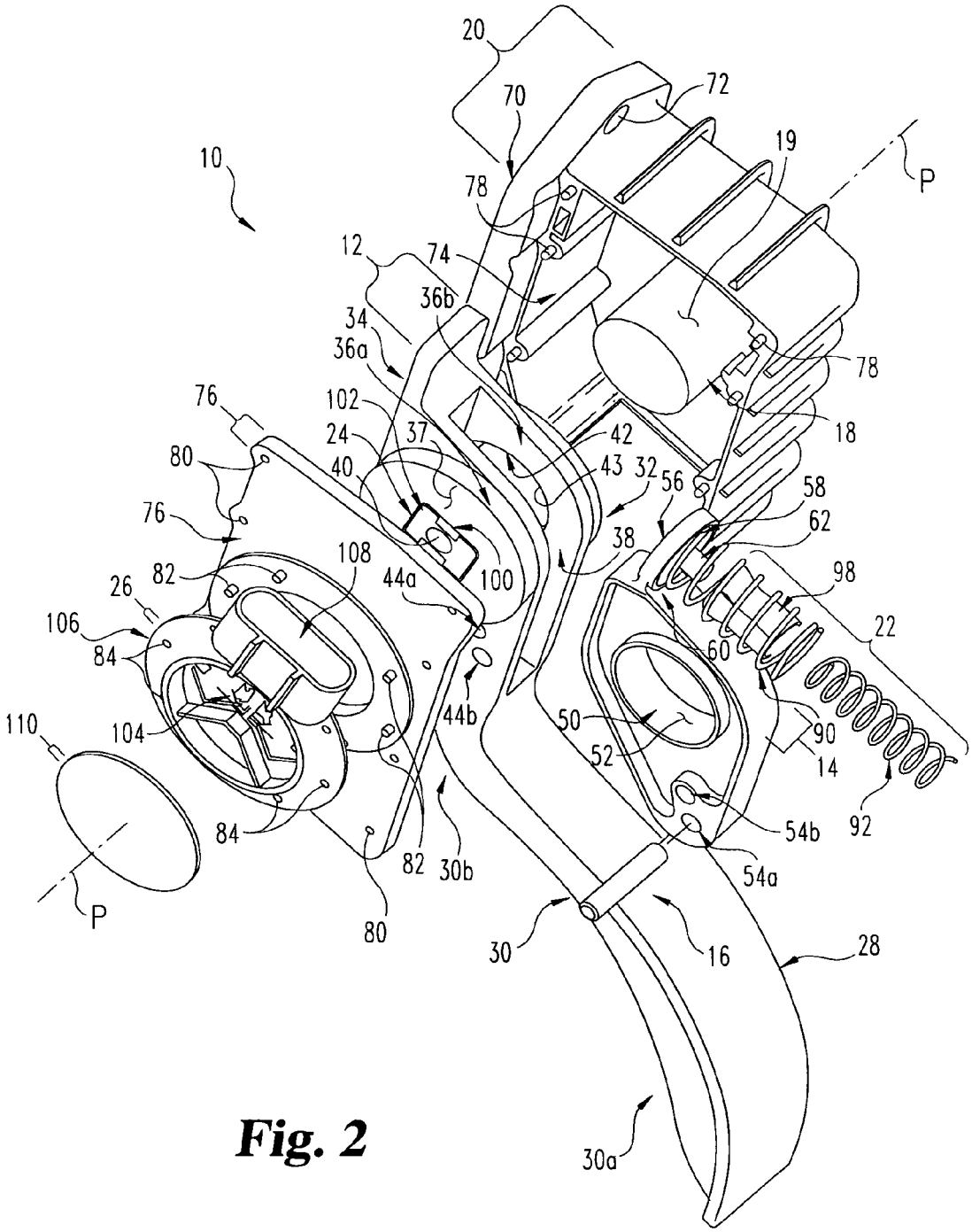
FIG. 2 is an exploded perspective view of the pedal assembly illustrated in FIG. 1.

Referring to FIGS. 1 and 2, shown therein is a pedal assembly 10 according to one form of the present invention. The pedal assembly 10 is generally comprised of a pedal arm 12, a clamp arm or drum 14 pivotally attached to the pedal arm 12 via a pivot pin 16, a pivot shaft 18 (FIGS. 2 and 4) extending from a pedal support bracket 20 and positioned along a pivot axis P, and a biasing mechanism 22 engaged between the clamp arm 14 and the pedal support bracket 20. In a further embodiment, the pedal assembly 10 is equipped with a magnetic circuit 24 engaged to the pedal arm 12, and a magnetic sensor device 26 (FIG. 2) for sensing changes in the rotational position of the magnetic field generated by the magnetic circuit 24. A pedal pad 28 may be attached to the pedal arm 12 to facilitate application of an activation force $F_A$ onto the pedal arm 12 by the operator of the vehicle to correspondingly pivot the pedal arm 12 about the pivot axis P.

The pedal support 20 is adapted for mounting to a vehicle, such as, for example, to the bulkhead or firewall of an automobile. The pedal arm 12 is pivotally mounted to the pivot shaft 18 such that pivotal movement of the pedal arm 12 about the pivot axis P results in rotational displacement of the magnetic field generated by magnetic circuit 24 relative to the sensor assembly 26. The sensor assembly 26 is engaged to the pedal support 20 and senses variations in the magnetic field during rotational displacement of the magnetic circuit 24, and also generates an output signal representative of the relative rotational position of the magnetic field and the pivotal position of the pedal arm 12. In one embodiment of the invention, the pedal assembly 10 is used in an automotive vehicle such as, for example, in association with an accelerator pedal to generate an electronic control signal corresponding to the pivotal position of the pedal arm 12, with the electronic signal controlling operation of a throttle valve. However, it should be understood that the pedal assembly 10 may also be used in association with other types of pedals to control other functions of a vehicle, such as, for example, braking or shifting. It should also be understood that the pedal assembly 10 may be used in areas outside of the automotive field. Further details regarding the components and operation of the pedal assembly 10 will be discussed in greater detail below.

In one embodiment of the invention, the pedal arm 12 includes an elongated lever portion 30 and a mounting portion 32, with the pedal pad 28 attached to the distal end portion 30*a* of the lever portion 30 and the mounting portion 32 extending from the proximal end portion 30*b* of the lever portion 30. As shown in FIG. 2, the mounting portion 32 of the pedal arm 12 includes a base portion 34 and a pair of oppositely disposed flanges 36*a*, 36*b* extending from the base portion 34 and defining a space 38 therebetween. The magnetic circuit 24 is engaged to one of the flanges 36*a*, with the flange 36*a* also defining a recess 40 arranged generally along the pivot axis P for receiving at least a portion of a magnetic flux sensor therein, the details of which will be discussed below. The opposite flange 36*b* defines an opening 42 extending therethrough and is also arranged generally along the pivot axis P. The opening 42 is sized and shaped to receive the pivot shaft 18 therethrough to pivotally couple the pedal arm 12 to the pedal support 20 and to allow pivotal movement of the pedal arm 12 about the pivot axis P. As should be appreciated, pivotal engagement of the pedal arm 12 to the pedal support 20 does not require a separate pin or shaft passing through aligned openings in the pedal arm 12 and the pedal support 20, thereby reducing manufacturing and/or assembly costs and reducing overall stack up tolerances associated with the pedal assembly 10. In one embodiment, the opening 42 extending through the flange 36*b* and the pivot shaft 18 associated with the pedal support 20 each have a substantially circular cross section to facilitate pivotal movement of the pedal arm 12 relative to the pedal support 20. However, other shapes and configurations of the opening 42 and the pivot shaft 18 are also contemplated as falling within the scope of the present invention. A pair of passages 44*a*, 44*b* extends through each of the opposite flanges 36*a*, 36*b* adjacent the proximal end 30*b* of the lever arm 30, with the passages 44*a*, 44*b* sized to receive the pivot pin 16 therein.

In a further embodiment of the invention, the clamp arm 14 is sized and shaped for receipt within the space 38 between the opposite flanges 36*a*, 36*b* of the pedal arm 14. The clamp arm 14 includes an opening 50 that is generally aligned with the opening 42 in the pedal arm 12 along the pivot axis P. The opening 50 is sized and shaped to receive the pivot shaft 18 therein, the purpose of which will be discussed below. In one embodiment, the opening 50 in the clamp arm 14 has a substantially circular cross section defining an inner circumferential bearing surface 52. However, other shapes and configurations of the opening 50 are also contemplated as falling within the scope of the present invention. Additionally, in the illustrated embodiment of the invention, the clamp arm 14 is configured such that the inner circumferential bearing surface 52 extends a full 360 degrees. However, in other embodiments of the invention, the clamp arm 14 may be configured such that the inner circumferential bearing surface 52 extends less than 360 degrees, such as, for example, 210 degrees, 180 degrees, 120 degrees, 90 degrees, or any other angle less than 360 degrees.

The clamp arm 14 also defines a pair of passages 54*a*, 54*b* extending therethrough which are generally aligned with the passages 44*a*, 44*b* extending through the flanges 36*a*, 36*b* of the pedal arm 12. The pivot pin 16 extends through an aligned pair of the passages 44*a*, 54*a* to pivotally couple the clamp arm 14 to the pedal arm 12. However, it should be understood that the pivot pin 16 may alternatively extend through the aligned pair of the passages 44*b*, 54*b* to pivotally couple the clamp arm 14 to the pedal arm 12. The clamp arm 14 further includes a retainer portion 56 for maintaining engagement with the biasing mechanism 22. The retainer portion 56 includes a flange portion 58 defining a recessed area 60 for engagement with a first portion of the biasing mechanism 22, and a stem portion 62 extending from the flange portion 58 for engagement with a second portion of the biasing mechanism 22, the details of which will be discussed below. Although the illustrated embodiment of the pedal assembly 10 depicts the pivot pin 16 as being positioned adjacent the proximal end 30*b* of the lever arm 30 and the biasing mechanism 22 as being positioned adjacent the upper end of the mounting portion 32, it should be understood that the position and orientation of the pivot pin 16 and the biasing mechanism 22 is not a critical aspect of the invention, and that other positions and orientations are also contemplated. For example, it should be understood that the positions of the pivot pin 16 and the biasing mechanism 22 may be reversed, with the pivot pin 16 positioned adjacent the upper end of the mounting portion 32 and the biasing mechanism positioned adjacent the proximal end 30*b* of the lever arm 30. Other alternative positions and orientations of the pivot pin 16 and the biasing mechanism 22 are also contemplated as would occur to one of skill in the art.

In the illustrated embodiment of the invention, the pedal support 20 includes a mounting plate or rail 70 adapted to mount the pedal support 20 to a substrate. Specifically, the mounting plate 70 defines a number of apertures 72 for receiving a corresponding number of fasteners, such as screws, for threading engagement with the substrate. In one embodiment of the invention, the pivot shaft 18 is formed integral with the pedal support 20. In a specific embodiment, the pedal support 20 is formed of a plastic material and is produced via an injection molding technique such that the pivot shaft 18 and the pedal support 20 are formed as a single-piece, unitary structure. However, it should be understood that in other embodiments of the invention, the pivot shaft 18 may be formed separately and subsequently attached to the pedal support 20 by one or more fasteners or by other attachment techniques such as welding or bonding.

In a further embodiment of the invention, the pedal support 20 includes an open side 74 to facilitate the introduction and assembly of the pedal arm 12, the clamp arm 14 and the biasing mechanism 22 with the pedal support 20. A cover 76 is provided to close off the open side 74 of the pedal support 20 (FIG. 2). In one embodiment, the pedal support 20 includes a number of projections or pins 78 that are inserted within corresponding apertures 80 in the cover 76 to selectively retain the cover 76 on the pedal support 20. However, it should be understood that other methods for attaching the cover 76 to the pedal support 20 are also contemplated. The cover 76 further includes a number of locating elements 82 configured to locate the magnetic sensor device 26 in the correct position and orientation relative to the pedal support 20 and relative to the magnetic circuit 24. The locating elements 82 are preferably molded directly into the cover 76. In one embodiment, the locating elements 82 are configured as a number of projections or pins extending from an outer surface of the cover 76. The pins 82 are inserted into corresponding apertures 84 in the magnetic sensor device 26 to selectively retain the magnetic sensor device 26 on the cover 76, and to maintain the magnetic sensor device 26 in the correct position and orientation relative to the pedal support 20 and the magnetic circuit 24.

In the illustrated embodiment, the locating pins 82 and the locating apertures 84 are arranged in a circular-shaped pattern; however, other configurations and arrangements are also contemplated. Additionally, in one embodiment, the locating pins 82 are sized and configured to be press fit within the locating apertures 84 in the sensor device 26 to removably engage the magnetic sensor device 26 to the cover 76 without any additional fastening devices. In this manner, the sensor device 26 can be quickly and easily removed from the pedal assembly 10 for replacement by a different sensor device 26. Although the pedal assembly 10 has been illustrated and described as including a particular configuration of locating/retaining elements to engage the sensor device 26 to the cover 76, it should be understood that other types and configurations of locating/retaining elements are also contemplated as falling within the scope of the present invention.

Figure 4:
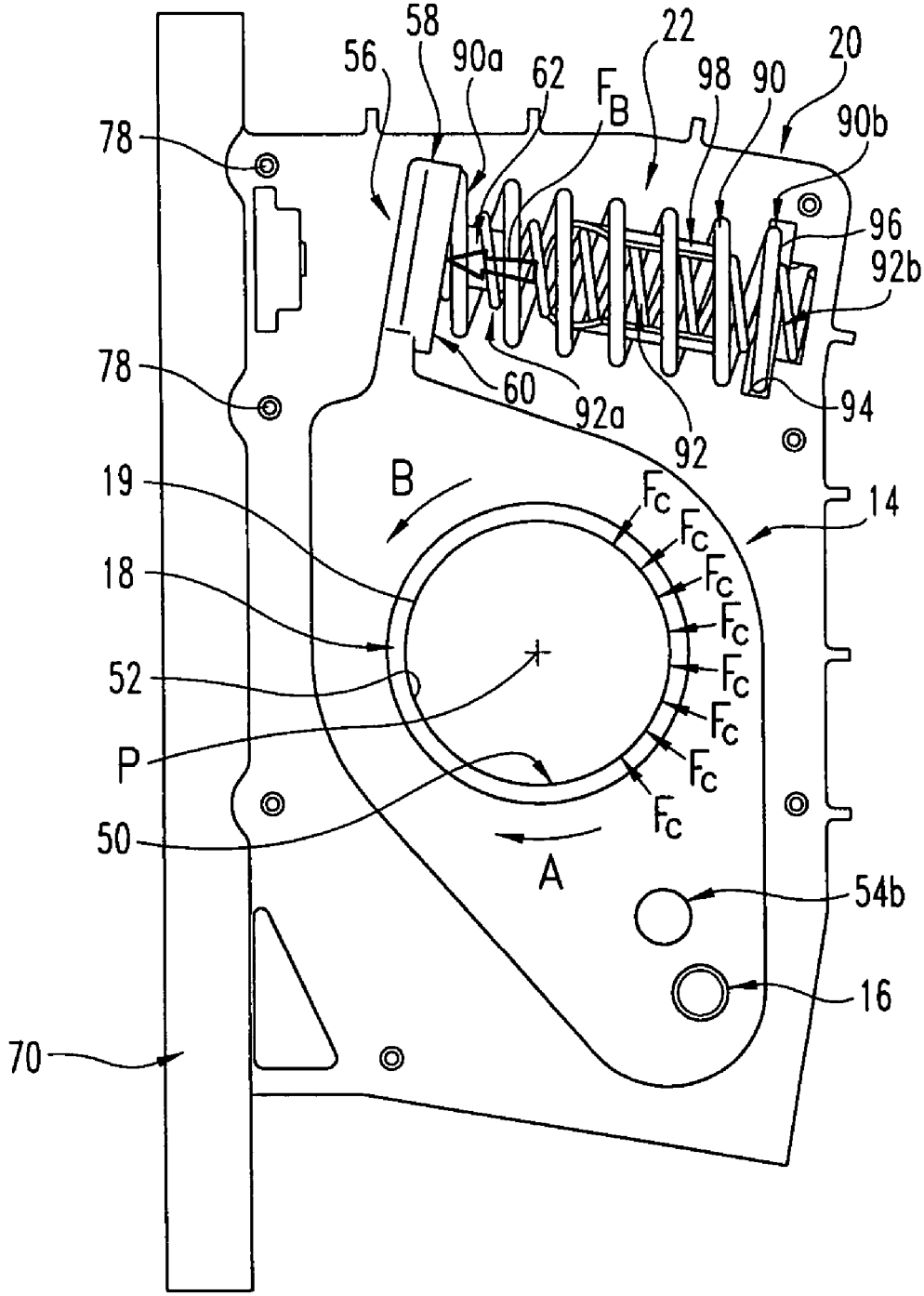
FIG. 4 is a side elevational view of a portion of the pedal assembly illustrated in FIG. 1 showing internal forces developed within the pedal assembly when the pedal arm is activated.

As indicated above, the biasing mechanism 22 is engaged between the retainer portion 56 of the clamp arm 14 and an opposite wall of the pedal support 20, the function of which will be discussed below. In the illustrated embodiment of the invention, the biasing mechanism 22 comprises a pair of nested coil springs 90, 92 arranged generally concentric to one another. As shown in FIG. 4, the outer coil spring 90 includes a first end portion 90*a* positioned within the recessed area 60 defined by the flange portion 58 extending from the clamp arm 14, and a second end portion 90*b* positioned within a recessed area 94 defined in the opposite wall of the pedal support 20. The inner coil spring 92 includes a first end portion 92*a* positioned about the stem portion 62 extending from the flange portion 58, and a second end portion 92*b* positioned within a recessed area 96 defined in the opposite wall of the pedal support 20. As should be appreciated, engagement of the coil springs 90, 92 between the retainer portion 56 and the recessed areas 94, 96 in the pedal support wall maintain the coil springs 90, 92 in the appropriate position between the clamp arm 14 and the pedal support 20. Additionally, a spring alignment device 98 may be positioned between the inner and outer springs 90, 92 to maintain adequate spacing therebetween. Although the biasing mechanism 22 has been illustrated and described as comprising a pair of nested coil springs, it should be understood that other types and arrangements of coil springs are also contemplated for use in association with the present invention, and that any number of coil springs may be used, including a single coil spring or three or more coil springs. It should also be understood that other types of biasing mechanisms are also contemplated for use in association with the present invention.

In the illustrated embodiment of the invention, the magnetic circuit 24 is attached directly to the pedal arm 12, and more specifically to the flange 36*a* of the pedal arm mounting portion 32. In this manner, the magnetic circuit 24 is rotationally displaced relative to the pivot axis P during pivotal movement of the pedal arm 12, the function of which will be discussed below. In one embodiment of the invention, the magnetic circuit 24 is integral with the flange 36*a* of the pedal arm 12. In the illustrated embodiment, the magnetic circuit 24 is insert molded directly into the flange 36*a* of the pedal arm 12. However, in other embodiments of the invention, a cavity may be formed in the flange 36*a* into which the magnetic circuit 24 is subsequently press fit or otherwise inserted to form an integrated pedal arm/magnetic circuit assembly. It should be understood that other techniques for coupling the magnetic circuit 24 to the pedal arm 12 are also contemplated as falling within the scope of the present invention.

In one embodiment of the invention, the magnetic circuit 24 is at least partially positioned below the outer, axially-facing surface 37 of the flange 36*a*. In a preferred embodiment, the entire magnetic circuit 24 is positioned below the outer surface 37 of the flange 36*a*. As will be discussed in greater detail below, the magnetic circuit 24 defines an air gap G wherein a magnetic field is generated, with the sensor device 26 sensing changes in the magnetic field resulting from rotation of the magnetic field about the pivot axis P. As indicated above, the flange 36*a* of the pedal arm 12 defines a recess 40 extending inwardly from the outer surface 37 and positioned generally along the pivot axis P. The recess 40 extends into the air gap G defined the magnetic circuit 24 so as to position the recess within the magnetic field. The recess 40 is in turn sized to receive one or more magnetic flux sensors associated with the sensor device 26 to thereby position the flux sensors within the magnetic field, further details of which will be discussed below.

Although the magnetic circuit 24 is preferably disposed within the mounting portion 32 of the pedal arm 12 in a recessed position below the outer surface 37, it should be understood that the magnetic circuit 24 may alternatively be attached or otherwise engaged directly to the outer surface 37 or to other regions of the mounting portion 32. It should further be appreciated that by integrating the magnetic circuit 24 into the mounting portion 32 of the pedal arm 12, stack-up positional tolerances are significantly reduced relative to prior pedal designs that position the magnetic circuit remote from pivot elements. Additionally, integrating the magnetic circuit 24 into the mounting portion 32 of the pedal arm 12 eliminates the need for a separate rotor or other connector elements that are prevalent in prior pedal designs. As a result, the overall design of the pedal assembly 10 is simplified, thereby reducing manufacturing and assembly costs. Additionally, positional tolerances are also significantly reduced so as to improve the performance characteristics associated with the pedal assembly 10.

In one embodiment of the invention, the magnetic circuit 24 includes one or more magnets 100 and an outer loop pole piece or flux ring 102, with the magnets 100 and the pole piece 102 cooperating to generate a magnetic field within the inner region of the loop pole piece 102. The magnetic circuit 24 is particularly well suited for integration into the pedal arm 12 because of its relatively compact size and its ability to be positioned and arranged along the pivot axis P of the pedal assembly 10. In one embodiment, the magnetic circuit 24 is positioned and arranged such that the magnetic field extends transversely across and intersects the pivot axis P. However, it should be understood that other types, configurations and arrangements of magnetic circuits capable of producing a magnetic field are also contemplated for use in association with the present invention. For example, in another embodiment, the magnetic circuit 24 need not necessarily include the loop pole piece 102 to generate a suitable magnetic field. Additionally, it should be understood that the magnetic circuit 24 may include a single magnet or two or more magnets to generate a suitable magnetic field. It should also be understood that the particular magnetic circuit 24 illustrated and described above is exemplary, and that other types and configurations of magnetic circuits are also suitable for use in association with the present invention. For example, U.S. Pat. Nos. 6,137,288, 6,310,473, 6,417,664 and 6,472,865, U.S. Patent Application Publication No. 2003/0132745, and U.S. patent application Ser. No. 10/998,530, all commonly assigned to the Assignee of the subject application, disclose various types and configurations of magnetic circuits suitable for use in association with the present invention, the contents of which are hereby incorporated by reference in their entirety.

In one embodiment of the invention, the magnets 100 are rare earth magnet having a substantially rectangular configuration. However, it should be understood that other types of magnets having different shapes and configurations are also contemplated for use in association with the present invention. Additionally, the pole piece 102 is formed of a magnetically permeable material, such as, for example, a soft magnetic steel or cold rolled steel and has a substantially rectangular configuration. However, it should be understood that other types of pole pieces formed of other materials and having different shapes and configurations are also contemplated for use in association with the present invention.

In the illustrated embodiment of the invention, the magnetic sensor device 26 includes one or more magnetic flux sensors 104 that are mounted within a sensor housing 106 which also contains electronic circuitry associated with the operation of the magnetic flux sensors 104. It should be understood that the sensor device 26 may include a single magnetic flux sensor or two or more magnetic flux sensors depending on the particular sensing requirements associated with the pedal assembly 10. The sensor housing 106 also includes an integral electrical connector 108 for connecting the electronics associated with the non-contact position sensor with a cable or wire harness, which is in turn connected to electronic circuitry or a vehicle control system such as a computer. In a preferred embodiment, the electrical connector 108 is molded directly into the sensor housing 106. Although the pedal assembly 10 has been illustrated and described as providing a particular electrical connection between the sensor device 26 and electrical equipment located remote from the pedal assembly 10, it should be understood that other types and configurations of electrical connections are also contemplated as falling within the scope of the present invention.

For purposes of the present invention, a "magnetic flux sensor" is broadly defined as any device that is operable to sense magnetic flux density and to generate an electronic signal representative of the magnitude of the magnetic flux density. In one embodiment of the invention, the magnetic flux sensors 104 are Hall effect devices that are capable of sensing magnetic flux density passing perpendicularly through the sensing plane of the device. In one embodiment, the Hall-effect devices are of the programmable type; however, non-programmable Hall-effect devices are also contemplated for use in association with the present invention. Further details regarding the characteristics and operation of magnetic flux sensors, and particularly a Hall-effect type magnetic flux sensor, are disclosed in U.S. Pat. No. 6,137,288, the contents of which have been incorporated herein in their entirety. It should also be understood that other types of magnetic flux sensors are also contemplated for use in association with the present invention, including, for example, a magneto-resistive (MR) sensor, a magnetic diode sensor, or any other magnetic field-sensitive sensor device that would occur to one of skill in the art.

When the sensor device 26 is properly engaged to the pedal support cover 76, and when the pedal support cover 76 is properly engaged to the pedal support 20, the magnetic flux sensors 104 are positioned within the recess 40 formed in the flange 36*a* of the pedal arm 12 and are arranged generally along the pivot axis P. As a result, the sensors 104 are positioned within the magnetic field generated by the magnetic circuit 24. A removable lid or cover 110 may be positioned over the open side of the sensor housing 106 to protect the magnetic flux sensors 104 and the electronic circuitry contained within the sensor housing 106 from the outer environment.

Figure 3:
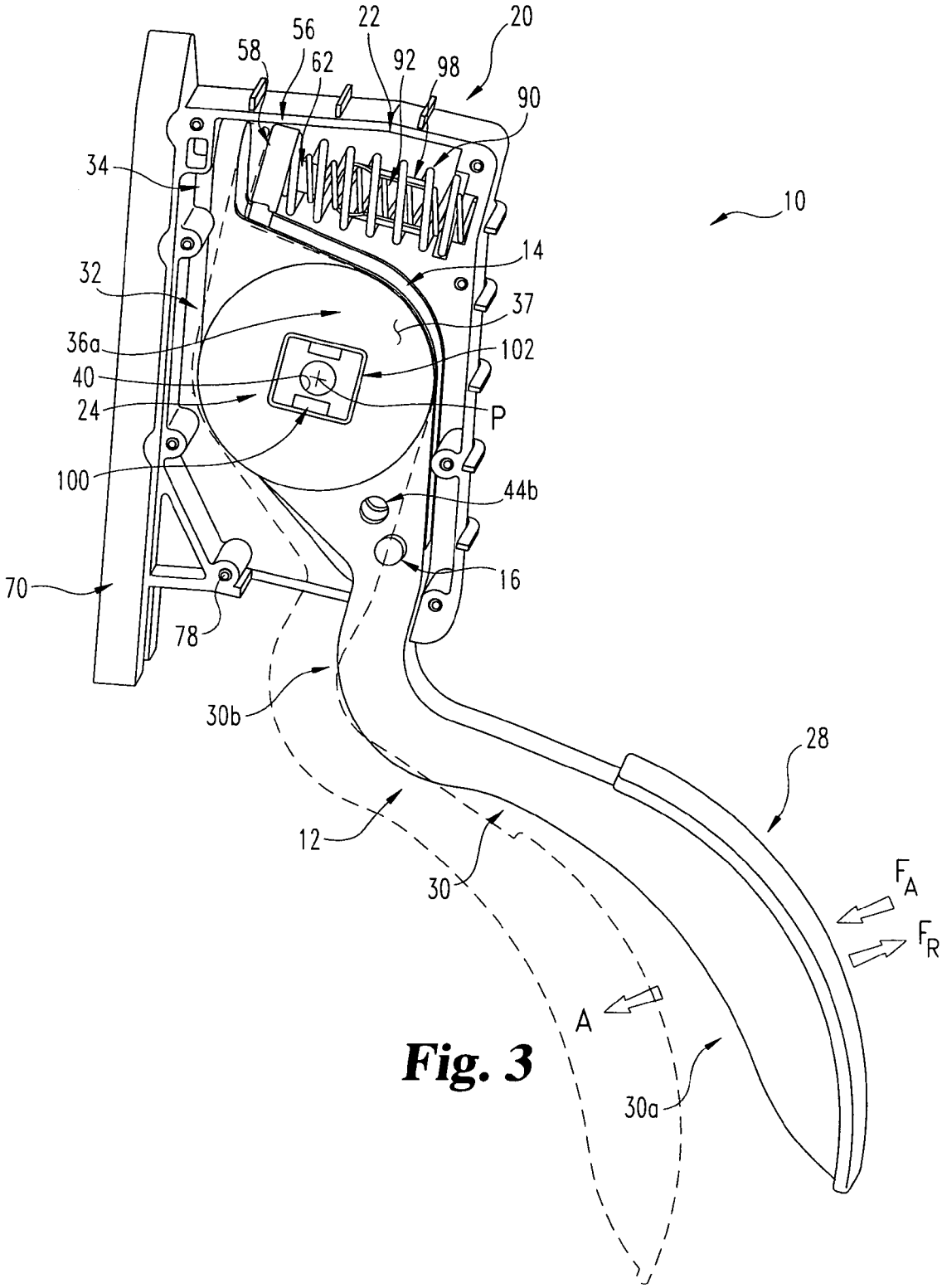
FIG. 3 is a side elevational view of the pedal assembly illustrated in FIG. 1.

Having illustrated and described the various components and features associated with the pedal assembly 10, reference will now be made to operation of the pedal assembly 10 according to one form of the present invention. As illustrated in FIG. 3, when the operator of the vehicle exerts an activation force $F_A$ onto the pedal pad 28, the pedal arm 12 will pivot about the pivot axis P in the direction of arrow A. Since the clamp arm 14 is connected to the pedal arm 12 via the pin 16, pivotal movement of the pedal arm 12 will correspondingly pivot the clamp arm 14 about the pivot axis P in the direction of arrow A (FIG. 4). As a result of the pivotal movement of the clamp arm 14 in the direction of arrow A, the coil springs 90, 92 are compressed between the retainer portion 56 of the clamp arm 14 and the opposite inner wall of the pedal support 20.

As shown in FIG. 4, when the clamp arm 14 is pivoted in the direction of arrow A, the coil springs 90, 92 are compressed and exert a biasing force $F_B$ against the retainer portion 56 of the clamp arm 14. The biasing force $F_B$ exerted onto the retainer portion 56 in turn slightly rotates the clamp arm 14 about the pivot pin 16 in the direction of arrow B. Rotation of the clamp arm 14 in the direction of arrow B exerts a compression force $F_C$ onto the pivot shaft 18, thereby resulting in frictional engagement between the inner circumferential bearing surface 52 of the clamp arm 14 and the outer circumferential surface 19 of the pivot shaft 18. Additionally, pivotal movement of the pedal arm 12 in combination with exertion of the compression force $F_C$ onto the pivot shaft 18 by the clamp arm 14 also results in compression of the inner circumferential compression surface 43 of the opening 42 in the pedal arm mounting portion 32 against the outer circumferential surface 19 of the pivot shaft 18. In the illustrated embodiment of the invention, the compression force exerted onto pivot shaft 18 by the pedal arm mounting portion 32 generally opposes the compression force $F_C$ generated by the clamp arm 14. As should be appreciated, the compression force generated by the pedal arm mounting portion 32 results in additional frictional engagement with the outer circumferential surface 19 of the pivot shaft 18.

In one embodiment of the invention, the inner surface 52 of the clamp arm 14 and/or the outer surface 19 of the pivot shaft 18 may be roughened to increase frictional engagement therebetween. Additionally, the relatively large surface area of engagement between the clamp arm 14 and the pivot shaft 18 tends to minimize frictional wear, thereby increasing the useful life span of the pedal assembly 10. As should be appreciated, frictional engagement between the clamp arm 14 and the pivot shaft 18 provides increased resistance to further pivotal movement of the pedal arm 12 (and the clamp arm 14) in the direction of arrow A. Additionally, frictional engagement between the pedal arm mounting portion 32 and the pivot shaft 18 provides added resistance to further pivotal movement of the pedal arm 12 in the direction of arrow A. As should also be appreciated, as the pedal arm 12 is depressed further and pivoted in the direction of arrow A, the coil springs 90, 92 will be compressed to a greater degree, which in turn correspondingly increases the biasing force $F_B$ against the retainer portion 56 of the clamp arm 14, thereby resulting in a greater compression force $F_C$ being exerted onto the pivot shaft 18. As should be apparent, an increase in the compression force $F_C$ will correspondingly increase frictional engagement between the inner circumferential bearing surface 52 of the clamp arm 14 and the outer circumferential surface 19 of the pivot shaft 18, which will in turn increase resistance to further pivotal movement of the pedal arm 12 (and the clamp arm 14) in the direction of arrow A. In other words, as the pedal arm 12 is continually depressed and pivoted in the direction of arrow A, resistance to further pivotal movement of the pedal arm 12 in the direction of arrow A is correspondingly increased.

In the illustrated embodiment of the invention, the inner circumferential bearing surface 52 of the clamp arm 14 and the outer circumferential surface 19 of the pivot shaft 18 are each generally uniform and substantially uninterrupted. However, it should be understood that either or both of the inner circumferential bearing surface 52 and the outer circumferential surface 19 may be interrupted or modified to provide partial or multiple surface contact regions. As should be appreciated, such interruptions or modifications to the inner circumferential surface 52 and/or the outer circumferential surface 19 tend to change the frictional resistance characteristics associated with the pedal arm assembly 10, and possibly other characteristics including pedal performance, durability, consistency, life span, etc. In one alternative embodiment of the invention, either or both of the inner circumferential surface 52 and the outer circumferential surface 19 may be interrupted by one or more grooves, recessed areas, or surface depressions. In one specific embodiment, such grooves, recessed areas or surface depressions may extend in a circumferential direction, an axial direction, or in any other direction. In another specific embodiment, the inner circumferential surface 52 and/or the outer circumferential surface 19 may be provided with surface depressions configured as dimples or flattened areas. In still other embodiments, the inner circumferential surface of the opening 42 in the pedal arm mounting portion 32 may also be interrupted or modified to change the frictional resistance characteristics associated with the pedal arm assembly 10.

Figure 5:
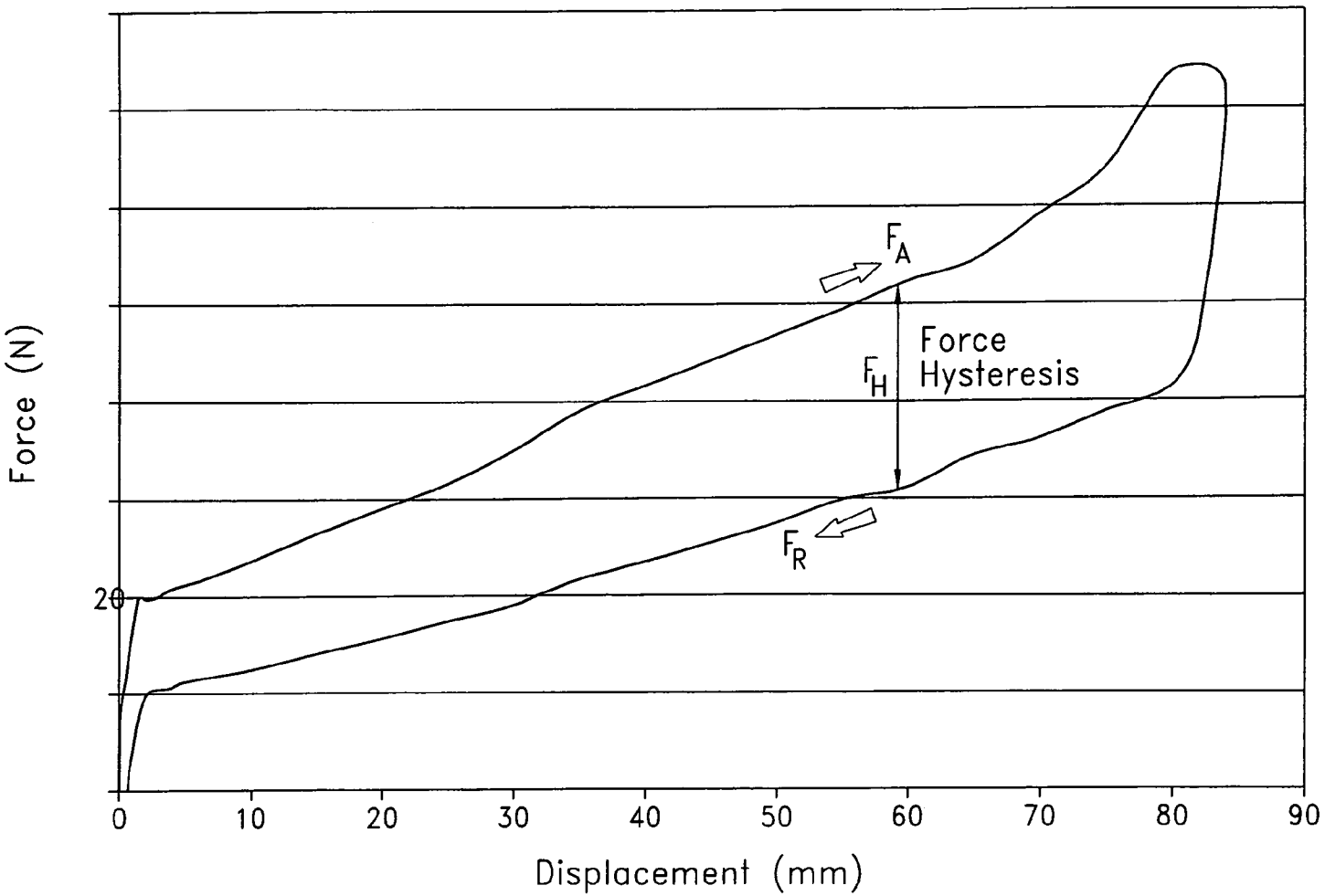
FIG. 5 is an exemplary graph illustrating force hysteresis $F_H$ between pedal activation force $F_A$ and pedal return force $F_R$ as a function of pedal arm displacement.

When the operator of the vehicle removes or reduces the activation force $F_A$ exerted onto the pedal pad 28, the compressed coil springs 90, 92 will urge the pedal arm 12 and the clamp arm 14 back toward the home or "at rest" position shown in FIGS. 1 and 3. As should be appreciated, as the coil springs 90, 92 are allowed to return toward their uncompressed state, the biasing force $F_B$ exerted onto the retainer portion 56 of the clamp arm 14 will be correspondingly reduced. As should also be appreciated, a reduction in the biasing force $F_B$ will correspondingly reduce the compression force $F_C$ exerted onto the pivot shaft 18, thereby lessening frictional engagement between the inner circumferential bearing surface 52 of the clamp arm 14 and the outer circumferential surface 19 of the pivot shaft 18 and reducing resistance to pivotal movement of the pedal arm 12 back toward the home or "at rest" position illustrated in FIGS. 1 and 3. As should further be appreciated, the force hysteresis $F_H$ at any given position of the pedal arm 12 is the difference between the activation force $F_A$ required to pivot the pedal arm 12 in the direction of arrow A and the return force $F_R$ working against the operator's foot to return the pedal arm 12 back to the home or "at rest" position. Additionally, it should be understood that the force hysteresis $F_H$ is proportional to the frictional forces developed between the clamp arm 14 and the pivot shaft 18 and between the pedal arm 12 and the pivot shaft 18. Accordingly, the amount of force hysteresis $F_H$ associated with the pedal assembly 10 increases as the pedal arm 12 is pivotally displaced in the direction of arrow A. This concept is illustrated in the exemplary force-displacement graph in FIG. 5.

As indicated above, the magnetic flux sensors 104 are positioned within the magnetic field generated by the magnetic circuit 24. The magnetic flux sensors 104 in turn sense varying magnitudes of magnetic flux density as the magnetic circuit 24 and the magnetic field are rotated about the pivot axis P in response to pivotal movement of the pedal arm 12. During rotational displacement of the magnetic circuit 24, the orientation of the sensing planes of the magnetic flux sensors 104 will vary relative to the rotating magnetic field. If Hall devices are used, the sensed magnitude of magnetic flux density is measured in a direction perpendicular to the sensing plane of the Hall element. Accordingly, the sensed magnitude of magnetic flux density will be approximately zero when the sensing planes of the Hall devices are arranged generally parallel with the magnetic field, and will be at its maximum when the sensing planes of the Hall devices are arranged generally perpendicular to the magnetic field.

It should be appreciated that the magnetic field strength or flux density detected by the magnetic flux sensors 104 is proportional to the rotational position of the magnetic field relative to the pivot axis P, which in turn directly corresponds to the pivotal position of the pedal arm 12 relative to the pivot axis P. In a preferred embodiment of the invention, the magnitude of the magnetic flux density sensed by the magnetic flux sensors 100 varies in a substantially linear manner as the magnetic field and the pedal arm 12 are displaced about the pivot axis P. Additionally, in response to variation in the sensed magnitude of magnetic flux density, the sensor device 26 generates an electronic voltage signal that is proportional to the sensed magnitude of magnetic flux density, which is in turn corresponds to the pivotal position of the pedal arm 12.

While the present invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protected.

What is claimed is:

1. A pedal assembly for use in association with a vehicle, comprising:

a pedal support adapted for mounting to the vehicle, said pedal support including a pivot shaft extending along a pivot axis, said pivot shaft having an outer circumference and an outer bearing surface formed directly on said outer circumference of said pivot shaft;

a pedal arm including a lever portion and a mounting portion, said mounting portion rotatably engaged to said pivot shaft to allow pivotal movement of said pedal arm about said pivot axis;

a clamp arm pivotally coupled to said pedal arm, said clamp arm having a compression surface facing said bearing surface of said pivot shaft;

a biasing member engaged between said pedal support and said clamp arm and arranged to apply a biasing force to said clamp arm to pivot said clamp arm relative to said pedal arm and toward said pivot shaft to provide direct frictional engagement between said compression surface of said clamp arm and said bearing surface of said pivot shaft;

wherein said mounting portion of said pedal arm defines a space and wherein said mounting portion includes a pair of oppositely disposed flanges defining said space therebetween with said clamp arm positioned within said space, said biasing member arranged to apply said biasing force to said clamp arm to pivotally displace said clamp arm within said space of said mounting portion toward said pivot shaft to provide said direct frictional engagement between said compression surface of said clamp arm and said bearing surface of said pivot shaft; and wherein application of an activation force onto said lever portion of said pedal arm provides said pivotal movement of said pedal arm about said pivot axis, said pivotal movement of said pedal arm increasing said biasing force applied to said clamp arm by said biasing member to correspondingly increase said frictional engagement between said compression surface of said clamp arm and said bearing surface of said pivot shaft to provide increased resistance to further pivotal movement of said pedal arm about said pivot axis.

2. The pedal assembly of claim 1, wherein said biasing force applied to said clamp arm by said biasing member correspondingly increases frictional engagement between a second compression surface defined by said mounting portion of said pedal arm and said bearing surface of said pivot shaft to provide additional resistance to further pivotal movement of said pedal arm about said pivot axis.

3. The pedal assembly of claim 2, wherein said mounting portion of said pedal arm defines a pivot shaft opening arranged along said pivot axis and sized to rotatably receive said pivot shaft therein to pivotally engage said pedal arm to said pedal support, said second compression surface defined by said mounting portion extending at least partially about said pivot shaft opening.

4. The pedal assembly of claim 1, wherein said pivotal movement of said pedal arm about said pivot axis results in corresponding displacement of said clamp arm, said displacement of said clamp arm acting on said biasing member to increase said biasing force applied to said clamp arm by said biasing member.

5. The pedal assembly of claim 4, wherein said displacement of said clamp arm results in compression of said biasing member between said clamp arm and said pedal support, said compression of said biasing member correspondingly increasing said frictional engagement between said compression surface and said bearing surface.

6. The pedal assembly of claim 1, wherein at least one of said compression surface of said clamp arm and said bearing surface of said pivot shaft is roughened to facilitate said frictional engagement therebetween.

7. The pedal assembly of claim 1, wherein said compression surface and said bearing surface are each uniform and uninterrupted.

8. The pedal assembly of claim 1, wherein a reduction in said activation force onto said lever portion of said pedal arm allows said biasing member to pivot said pedal arm about said pivot axis toward an at rest position, said pivotal movement of said pedal arm toward said at rest position decreasing said biasing force exerted onto said clamp arm by said biasing member to correspondingly decrease said frictional engagement between said compression surface and said bearing surface to provide decreased resistance to further pivotal movement of said pedal arm toward said at rest position.

9. The pedal assembly of claim 1, wherein said pivot shaft is formed integral with said pedal support to provide a unitary single-piece structure.

10. The pedal assembly of claim 1, wherein said mounting portion of said pedal arm defines an opening arranged along said pivot axis and sized to rotatably receive said pivot shaft therein to pivotally engage said pedal arm to said pedal support.

11. The pedal assembly of claim 1, wherein said clamp arm defines an opening extending therethrough and generally aligned with said pivot axis, said opening sized and shaped to receive said pivot shaft therein, said opening at least partially bound by said compression surface.

12. The pedal assembly of claim 1, wherein said biasing member comprises at least one compression coil spring.

13. The pedal assembly of claim 1, further comprising: a magnetic field generator providing a magnetic field, said magnetic field generator coupled to said pedal arm and arranged generally along said pivot axis such that said pivotal movement of said pedal arm results in rotational displacement of said magnetic field about said pivot axis; and a magnetic sensor device comprising at least one magnetic flux sensor positioned within said magnetic field to sense variations in said magnetic field during said rotational displacement and to generate an output signal representative of a rotational position of said magnetic field relative to said at least one magnetic flux sensor.

14. The pedal assembly of claim 13, wherein said magnetic field generator is integrated into said mounting portion of said pedal arm.

15. The pedal assembly of claim 13, wherein said magnetic field generator is integrated into said mounting portion of said pedal arm and is recessed below an axially facing outer surface of said mounting portion of said pedal arm.

16. The pedal assembly of claim 13, wherein said magnetic field transversely intersects said pivot axis and said at least one magnetic flux sensor is positioned generally along said pivot axis.

17. The pedal assembly of claim 1, wherein said clamp arm is pivotally connected to said pedal arm by a pivot pin.

18. The pedal assembly of claim 1, wherein at least one of said flanges defines a pivot shaft opening arranged along said pivot axis and sized to rotatably receive said pivot shaft therein to allow said pivotal movement of said pedal arm about said pivot axis.

19. A pedal assembly for use in association with a vehicle, comprising:

a pedal support adapted for mounting to the vehicle, said pedal support including a pivot shaft extending along a pivot axis, said pivot shaft having an outer bearing surface;

a pedal arm including a lever portion and a mounting portion, said mounting portion rotatably engaged to said pivot shaft to allow pivotal movement of said pedal arm about said pivot axis, wherein said mounting portion of said pedal arm includes a pair of oppositely disposed flanges defining a space therebetween;

a clamp arm pivotally coupled to said pedal arm, said clamp arm positioned within said space between said pair of oppositely disposed flanges and pivotally coupled to said pair of oppositely disposed flanges by a pivot pin, said clamp arm having a compression surface facing said bearing surface of said pivot shaft; and a biasing member engaged between said pedal support and said clamp arm and arranged to apply a biasing force to said clamp arm to pivot said clamp arm relative to said pedal arm and toward said pivot shaft to provide frictional engagement between said compression surface and said bearing surface; and wherein application of an activation force onto said lever portion of said pedal arm provides said pivotal movement of said pedal arm about said pivot axis, said pivotal movement of said pedal arm increasing said biasing force applied to said clamp arm by said biasing member to. correspondingly increase said frictional engagement between said compression surface of said clamp arm and said bearing surface of said pivot shaft to provide increased resistance to further pivotal movement of said pedal arm about said pivot axis.

20. A pedal assembly for use in association with a vehicle, comprising:

a pedal support adapted for mounting to the vehicle, said pedal support including a pivot shaft extending along a pivot axis, said pivot shaft having an outer bearing surface;

a pedal arm including a lever portion and a mounting portion, said mounting portion including a pair of oppositely disposed flanges defining a space therebetween, at least one of said flanges defining a pivot shaft opening arranged along said pivot axis and sized to rotatably receive said pivot shaft therein to allow pivotal movement of said pedal arm about said pivot axis;

a clamp arm positioned within said space between said pair of oppositely disposed flanges and pivotally coupled to said pedal arm, said clamp arm having a compression surface facing said bearing surface of said pivot shaft;

a position sensing device located adjacent one of said oppositely disposed flanges, said position sensing device operable to sense a pivotal position of said pedal arm relative to said pedal support and to generate an output signal representative of said pivotal position; and a biasing member engaged between said pedal support and said clamp arm and arranged to apply a biasing force to said clamp arm to pivot said clamp arm relative to said pedal arm and toward said pivot shaft to provide frictional engagement between said compression surface and said bearing surface; and wherein application of an activation force onto said lever portion of said pedal arm provides said pivotal movement of said pedal arm about said pivot axis, said pivotal movement of said pedal arm increasing said biasing force applied to said clamp arm by said biasing member to correspondingly increase said frictional engagement between said compression surface of said clamp arm and said bearing surface of said pivot shaft to provide increased resistance to further pivotal movement of said pedal arm about said pivot axis.

21. The pedal assembly of claim 20, wherein said pivot shaft is formed integral with said pedal support and said clamp arm is pivotally coupled to said pair of oppositely disposed flanges by a pivot pin.

22. The pedal assembly of claim 20, wherein said clamp arm defines an opening extending therethrough and generally aligned with said pivot axis, said opening sized and shaped to receive said pivot shaft therein, said opening at least partially bound by said compression surface.

23. The pedal assembly of claim 20, wherein said position sensing device comprises:

a magnetic field generator providing a magnetic field, said magnetic field generator coupled to said one of said oppositely disposed flanges of said pedal arm and arranged generally along said pivot axis such that said pivotal movement of said pedal arm results in rotational displacement of said magnetic field about said pivot axis; and a magnetic sensor device comprising at least one magnetic flux sensor positioned within said magnetic field to sense variations in said magnetic field during said rotational displacement and to generate an output signal representative of a rotational position of said magnetic field relative to said at least one magnetic flux sensor; and wherein said magnetic field generator is integrated into said one of said oppositely disposed flanges of said pedal arm and said at least one magnetic flux sensor is positioned generally along said pivot axis.

* * * * *